US005192006A

United States Patent [19]

Van Brocklin et al.

[11] Patent Number: 5,192,006

[45] Date of Patent: Mar. 9, 1993

[54] LOW PROFILE PUMP

[75] Inventors: Owen F. Van Brocklin, Bristol; Glenn W. McGarvey, Watertown, both of Conn.

[73] Assignee: Risdon Corporation, Naugatuck, Conn.

[21] Appl. No.: 694,418

[22] Filed: May 1, 1991

[51] Int. Cl.[5] ..... B65D 88/54

[52] U.S. Cl. ..... 222/321; 222/385; 222/341

[58] Field of Search ..... 222/341, 321, 383, 385, 222/372, 380; 239/333, 331

[56] References Cited

U.S. PATENT DOCUMENTS

| | | | |
|---|---|---|---|
| 4,071,172 | 1/1978 | Balogh | 222/321 |
| 4,215,804 | 8/1980 | Giuffredi | 222/383 X |
| 4,234,127 | 11/1980 | Tada et al. | 222/321 X |
| 4,640,443 | 2/1987 | Corsette | 222/321 |
| 4,776,498 | 10/1988 | Maerte et al. | 222/385 X |
| 4,986,453 | 1/1991 | Lina et al. | 222/383 X |
| 4,991,747 | 2/1991 | Van Brocklin | 222/385 X |
| 5,083,682 | 1/1992 | Cater | 222/385 X |

*Primary Examiner*—Andres Kashnikow

*Assistant Examiner*—Kenneth DeRosa

*Attorney, Agent, or Firm*—St. Onge Steward Johnston & Reens

[57] ABSTRACT

An atomizing pump for dispensing liquids from a container which has a low profile and is non-throttling. The pump comprises a body, a spring biased piston, a lower valve openable and closable by both pressure in the pump body and by frictional interengagement with the pump piston with an extending upper end of the lower valve, and an upper valve that frictionally and sealingly fits in a lower chamber in the piston, but which can be moved against a spring force and the friction force when pressure in the pump reaches a critical limit, so that the upper valve moves into a larger upper chamber so that liquid can escape from the pump body. The upper valve preferably has an extending stem that contacts the extending upper end of the lower valve during the terminal portion of a downward stroke of the piston and an initial portion of an upward stroke of the piston so that the upper valve can be held open. The stem has two opposing tabs on its lower that are deformable to spread apart and retain the upper valve in the piston.

25 Claims, 4 Drawing Sheets

LOW PROFILE PUMP

BACKGROUND OF THE INVENTION

1. Field of the Invention

The present invention relates to manually operated reciprocating pumps for containers for spraying and atomizing liquids.

2. Background of the Invention

A conventional spray pump for dispensing liquids from a container includes a hollow body having openings in each end, into the upper end of which is fitted a hollow piston which is slidable reciprocally in the body with sealing fit, which piston is connected at its upper end to an actuator. The piston and body define an interior chamber having an opening at each end. The upper opening of the piston connects with a nozzle of the actuator from which the liquid is dispensed. An outlet valve is located in the upper opening. An inlet valve is located in the lower opening in the lower end portion of the body. Such valves may be ball valves, for example as disclosed in U.S. Pat. No. 3,963,150, or they may have other shapes, such as a planar valve element as disclosed in U.S. Pat. No. 3,991,914. Such valves are typically dependent on liquid pressure causing the ball to move away from the valve seat.

Typically, during a dispensing stroke of the piston, force is applied to the actuator, which causes the piston to slide downwardly into the body, causing the piston chamber to decrease in size and the pressure inside the chamber to increase. The liquid pressure inside the chamber causes the upper valve to open, while the lower valve is held closed by the same pressure, so that liquid flows out of the chamber through the open upper valve and is dispensed from the actuator. A spring is provided to return the piston to an up position when the actuator is released. During an upward stroke, a vacuum is formed in the chamber causing the lower valve to open so that liquid is drawn through the opening in the lower end of the body into the chamber.

In other pumps, frictional interengagement of the moving pump elements can cause the pump to operate, as disclosed in U.S. Pat. No. 4,606,479.

It is desirable to provide a pump with a low profile, so that the pump piston does not extend a long way above the container, and so that the pump body does not extend a significant distance into the container. However, the aforementioned pumps generally have required a substantial length to accommodate the stroke length needed to achieve the necessary shot size, and have thus required long piston sections.

These problems are addressed and resolved by the present invention as set forth hereafter.

SUMMARY OF THE INVENTION

It is an object of the invention to provide a pump with a low profile, that will extend only a relatively short distance above a container on which it is mounted. The low profile pump will preferably have a relatively short body so that the body does not extend deeply into the container, thereby enhancing the appearance of the entire package when the pump is installed in a clear glass bottle. It is an object of the invention to provide a pump for a container adapted to give a non-throttling spray of liquid. It is an object of the invention to provide substantially complete displacement of the shot of dispensed liquid with each pump actuation. It is an object of the invention to provide a pump which is readily primed.

These objects, and other objects which will become apparent from the description that follows, are achieved by a pump generally comprising a hollow body, a lower valve located in and adapted to close an opening in the lower end of the body, a hollow piston fitted into the body and slidable reciprocally with sealing fit in the body, an upper valve fitted into and slidable reciprocally inside the piston and having a sealing portion sized for frictional fit inside a lower chamber of the piston and for seating with an inwardly extending flange at the lower end of such lower chamber, the sealing portion being sized to provide a clearance between itself and an upper chamber of the piston, and a spring for biasing the upper valve against upward movement. The upper valve is movable against the spring bias from the piston lower chamber to the piston upper chamber to vent the body during an increase in pressure and is returned to the piston lower chamber by the biasing means to close the body during a decrease in pressure. The lower valve has an upper end which extends upwardly inside the body and the piston has a lower end for receiving the lower valve upper end with frictional fit so that the lower valve is frictionally engaged with the piston. This direct mechanical linkage of piston and lower valve enhances the action of the lower valve to seat against and to close the opening in the lower end of the body during a downward stroke of the piston. The lower valve will be easily unseated to open the opening in the lower end of the body during an upward stroke of the piston. The upper end of the lower valve is preferably provided with a plurality of ribs for enhancing the frictional fit between the lower valve and the body.

The pump includes a mechanism which holds the upper check valve open during priming of the pump. More specifically, the upper valve further comprises a central stem extending downwardly, which stem has a length selected such that it will contact the upper end of the lower valve during the terminal portion of a downward stroke of the piston and an initial portion of an upward stroke of the piston. This causes the upper valve to be held open mechanically during these portions of the downward and upward strokes of the piston. In the absence of mechanical force holding the valve open, the air pressure alone may be insufficient to open the valve and thus hamper or eliminate the pump's ability to vent air which, in turn, would make priming difficult. Mechanically opening the valve permits venting of air in the pump during priming.

The central stem of the upper valve has a lower end preferably comprising two opposing tabs extending downwardly. When the pump is first assembled, the piston is depressed with an actuator or a device having a similar structure, so that the tabs are forced against the upper end of the lower valve and spread apart. These spread apart tabs retain the upper valve in the piston during shipment prior to assembly of the actuator onto the piston.

The lower valve lower end is preferably provided with a cavity therein for fitting over the opening in the lower end of the body to provide room for the upper end of the dip tube if the dip tube is inserted during assembly too far into the pump. In addition, the cavity provides for ease of molding and permits the lower valve end to have a relatively thin, flexible wall.

A spring for biasing the piston against a downward stroke and for biasing the piston with an upward stroke is also provided. The lower end of the spring acts on a lower end of the lower valve to retain the lower valve in a predetermined zone of movement.

A collar for mounting on the body and for retaining the piston in the body, and a mounting cup, are preferably also provided, and an actuator and nozzle assembly are preferably seated on the upper end of the piston.

Other objects, aspects and features of the present invention in addition to those mentioned above will be pointed out in detail or will be understood from the following detailed description provided in conjunction with the accompanying drawings.

DESCRIPTION OF THE PREFERRED EMBODIMENT

Figure 1:
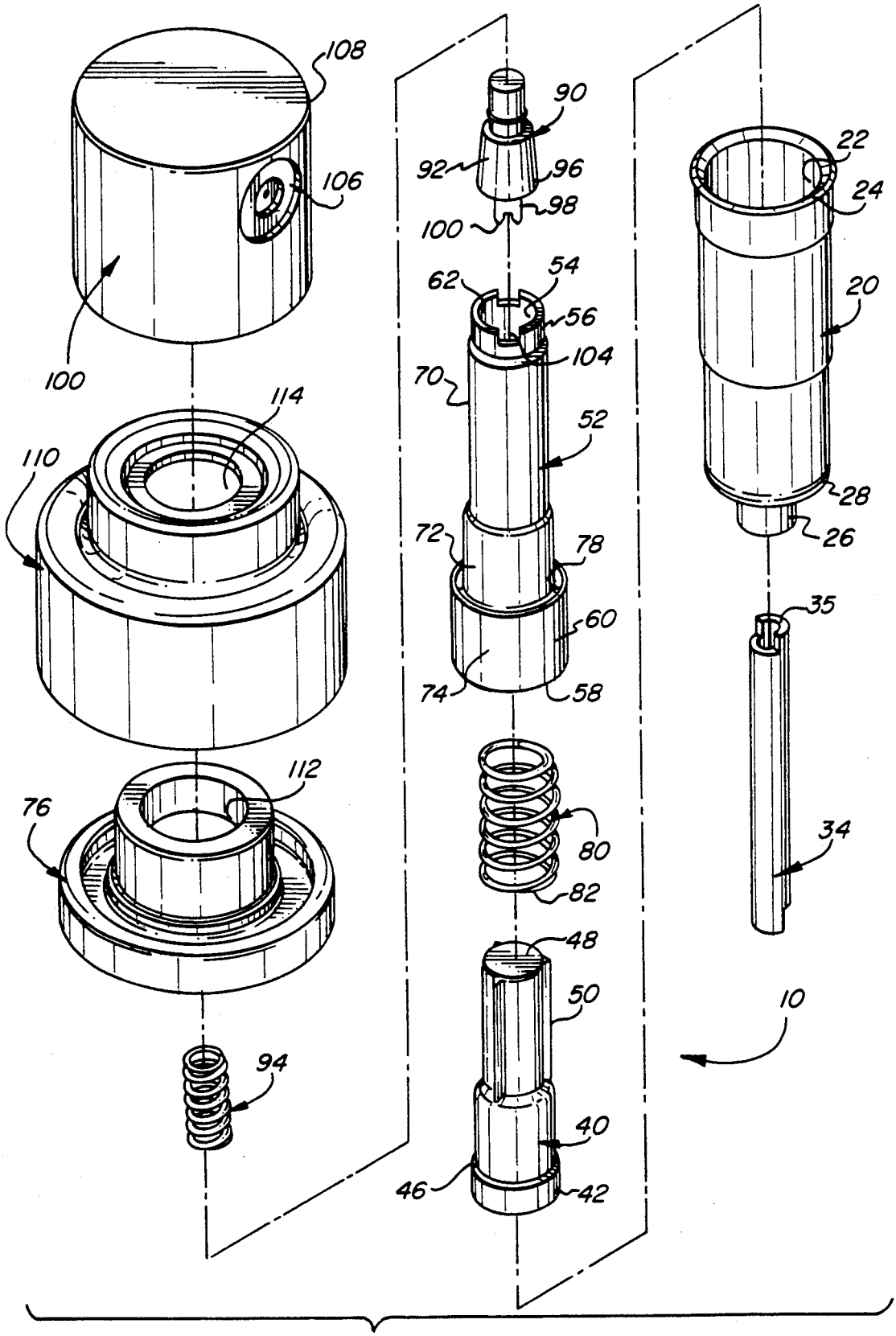
FIG. 1 is an exploded perspective view of an embodiment of the pump of the invention.

With reference to FIGS. 1-6, an embodiment of a pump 10 in accordance with the invention is shown. Pump 10 comprises a hollow body 20, a lower valve 40, a piston 52, and an upper valve 90.

Hollow body 20 has an upper opening 22 in its upper end 24 and a lower opening 26 in its lower end 28. Hollow body 20 is generally cylindrical in shape and circular in cross-section. The upper opening 22 is substantially the same size as the cross-section of the hollow chamber 30 within the body so that the piston 52 can be inserted therethrough. The lower opening 26 is preferably provided in a short tubular extension 32 which extends downwardly from the body 20. The tubular extension is provided so that a diptube 34 may be mounted thereon. Diptube 34 is preferably a flexible resilient tube, and is provided to extend down into the container onto which the pump 10 is to be mounted. Diptube 34 preferably has stepped diptube ends 35 to permit liquid to be drawn into the diptube if the lower end thereof is in contact with the bottom of the bottle, not shown.

Body 20 preferably has three different inner diameters. A first diameter zone extends from the upper end 24 to a distance such that the piston spring 80 will be stored in the second diameter zone when the piston 52 is depressed. The lower end of the second diameter zone is preferably precisely sized to receive an end of the piston spring 80. A third diameter zone which includes the zone of movement of the lower valve 40 extends from the lower end 82 of piston spring 80 to the lower end 28 of the body 20.

An annular ring 36 is preferably provided inside the lower end 28 of the body 20. The ring 36 surrounds the lower opening 26. Ring 36 defines a channel 38 located inside the lower end 28 of the body 20 between the ring 36 and the inner wall of the body 20. The ring 36 and channel 38 are generally annular in shape.

Lower valve 40 is located in and adapted to close lower opening 26 in the lower end 28 of body 20 when there is an increase in pressure inside hollow body 20. Valve 40 is operable to open the lower opening 26 during a decrease in pressure inside the hollow body 20. Valve 40 comprises a generally cylindrical element having a lower end 42 for fitting into the channel 38 in the lower end 28 of the body 20 with sealing fit against the ring 36. Lower end 42 is thus preferably also annular to seat against the ring 36 and fit into the annular channel 38. A cavity 44 is preferably provided in the lower valve 40 adjacent the lower end 42 of the lower valve. Cavity 44 provides room for the upper end of the diptube 34 if the diptube 34 is inserted too far into the pump. Cavity 44 also provides for ease of molding and permits the lower valve end 42 to have a relatively thin, flexible wall. A lip 46 is provided around the perimeter of lower valve 40 to permit the lower valve 40 to be retained within its zone of movement by the lower end of piston spring 80. The upper end 48 of lower valve 40 comprises an upwardly extending element that is preferably provided with a plurality of ribs 50 for providing a frictional fit with piston 52 as set forth hereafter. Preferably ribs 50 are three longitudinal ribs running the length of the lower valve 40.

Hollow piston 52 is fitted into the upper end 24 of body 20. Piston 52 is slidable reciprocally with sealing fit in body 20. Piston 52 has an upper opening 54 in its upper end 56 and a lower opening 58 in its lower end 60. Piston 52 has a valve chamber 62 consisting of an upper chamber 64 and a lower chamber 66. The upper chamber 64 and the lower chamber 66 are preferably cylindrical in shape with the upper chamber 64 having a diameter larger than the diameter of the lower chamber 66. A tapered transition 65 is provided between the chamber 64 and the chamber 66.

As can be seen in the Figures, valve chamber 62 most preferably comprises the upper zone of piston 52. Piston 52 preferably comprises three zones of different diameters. The upper zone 70 comprises the above described valve chamber 62 and has a diameter which is less than that of the middle zone 72 and of the lower zone 74. Flange 68 thus divides the upper zone 70 from the middle zone 72. Lower zone 74 has the largest diameter and is the portion of piston 52 adapted for sealing fit in body 20. Lower zone 74 also receives the upper end 84 of piston spring 80. Middle zone 72 has a lesser outer diameter than the lower zone 74 so that a collar 76 for mounting on the body 20 can fit into a lip 78 between the middle and lower zones 72 and 74 to retain the piston 52 in the body 20.

Figure 3:
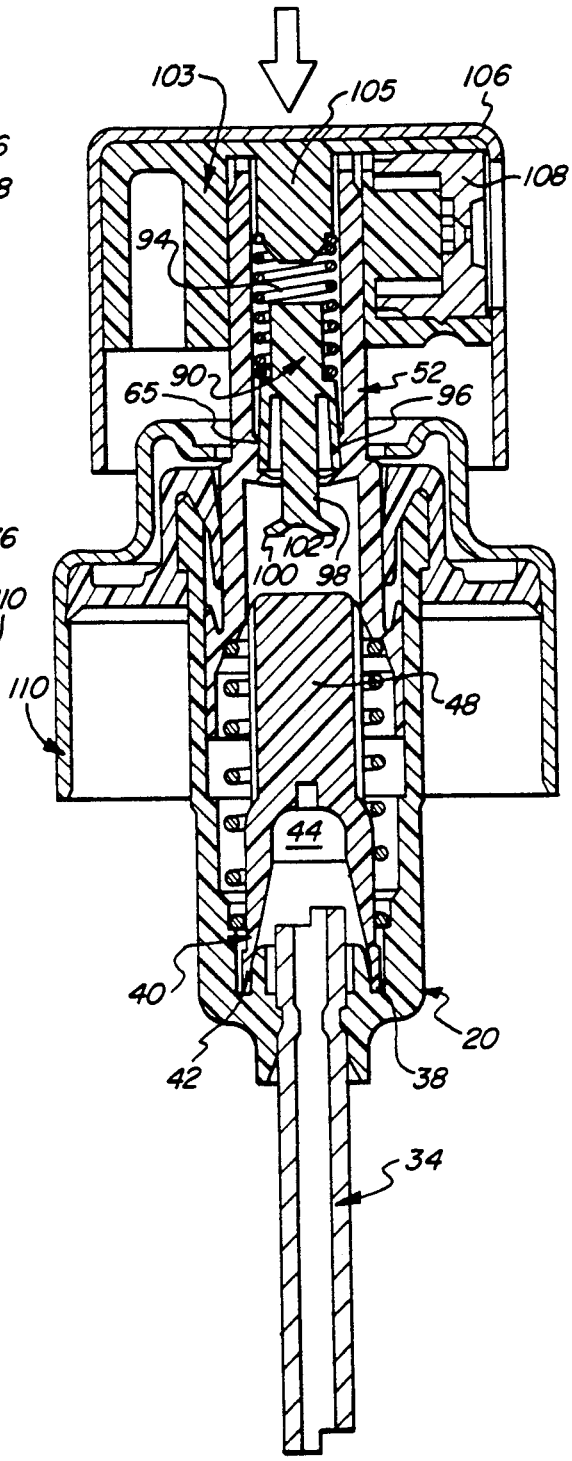
FIG. 3 is a cross-sectional view of the pump of FIG. 2 shown during a downward stroke of its piston.
Figure 4:
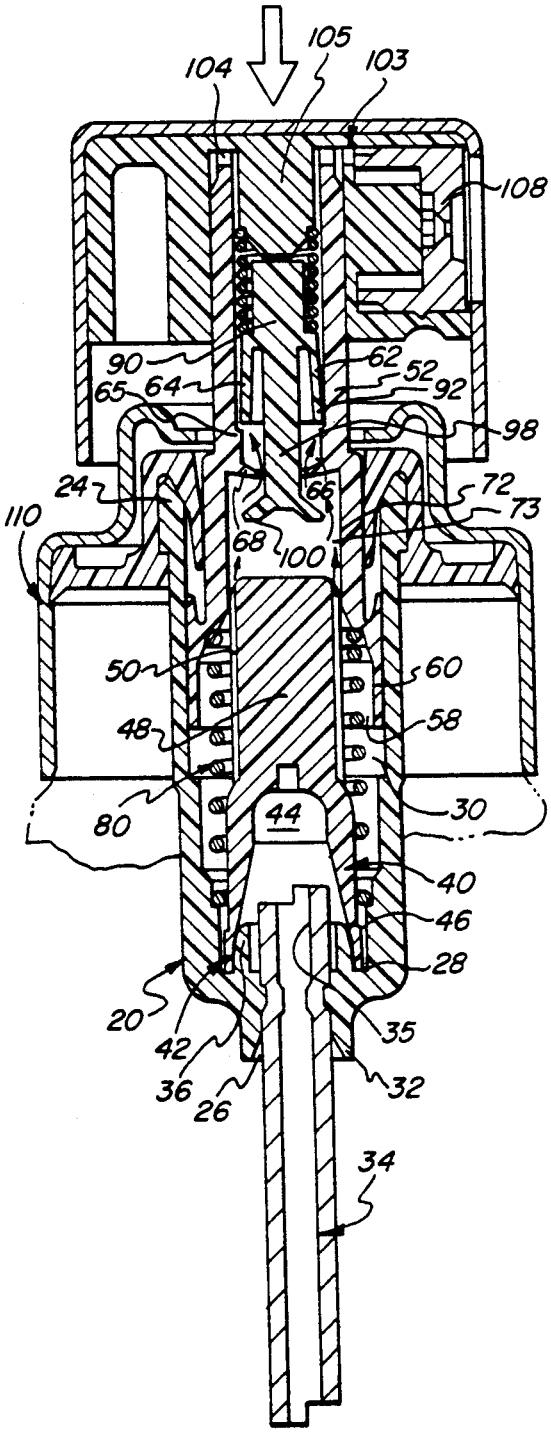
FIG. 4 is a cross-sectional view of the pump of FIG. 3 shown during a subsequent portion of a downward stroke of its piston with its upper valve opened.
Figure 5:
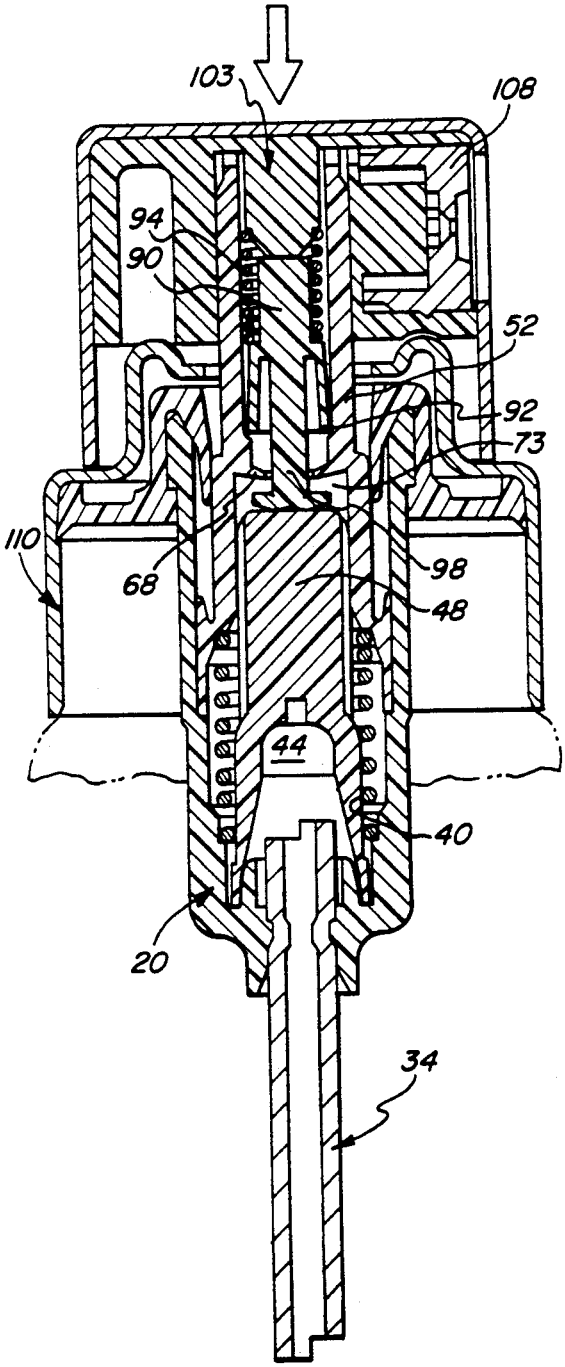
FIG. 5 is a cross-sectional view of the pump of FIG. 4 shown in the terminal portion of a downward stroke or the initial portion of an upward stroke of its piston.
Figure 6:
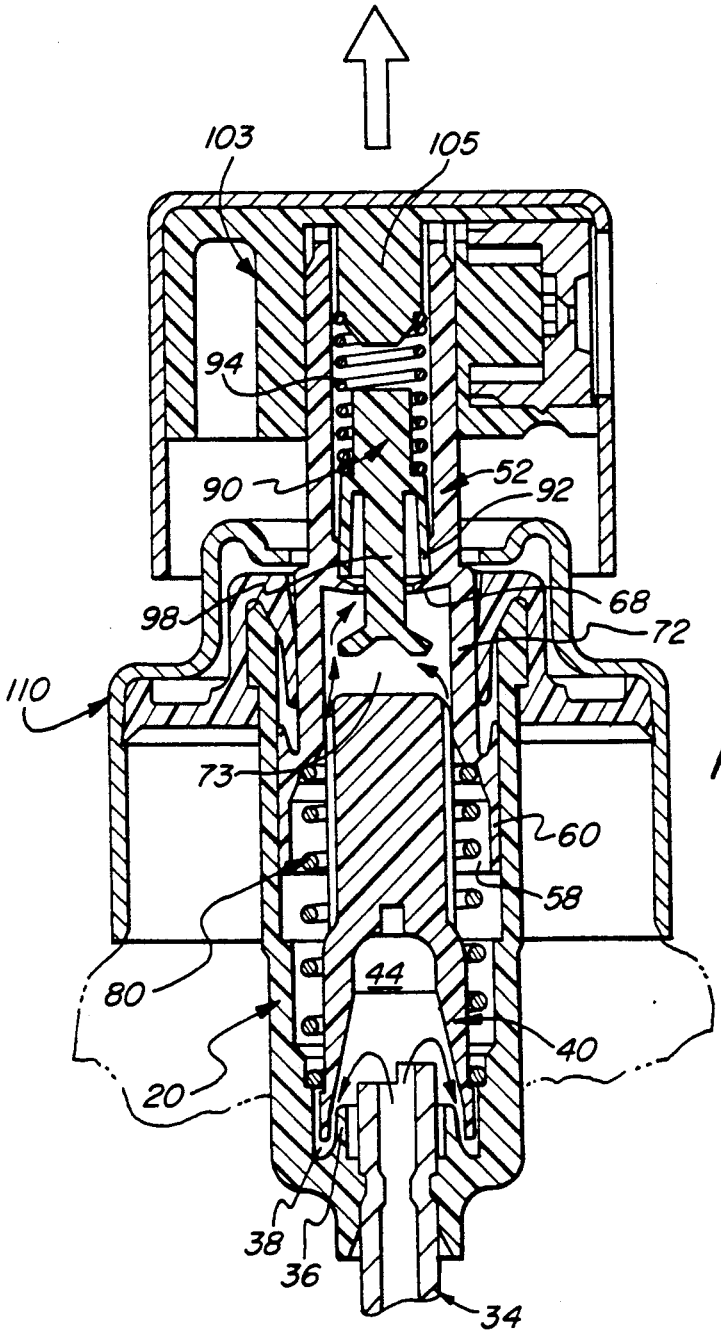
FIG. 6 is a cross-sectional view of the pump of FIG. 5 shown during an upward stroke of its piston.

The inner diameter of the middle zone 72, located generally in the lower end 60 of piston 52 is sized for frictional engagement with the upwardly extending upper end 48 of lower valve 40. The lower valve 40 is thereby frictionally engaged with the piston 52 to seat the lower valve 40 against and to close the opening 26 in the lower end 28 of the body during a downward stroke of the piston 52 as shown in FIGS. 3, 4, and 5. The frictional engagement also causes the piston 52 to unseat the lower valve 40 to open the opening 26 in the lower end 28 of the body 20 during an upward stroke of the piston 52 as shown in FIG. 6.

A piston spring 80 is installed to bias the piston 52 against a downward stroke and to bias the piston 52 with an upward stroke. A lower end 82 of the spring retains the lower end 42 of the lower valve 40 to retain the lower valve 40 in its predetermined zone of movement.

An upper valve 90 is fitted into and slidable reciprocally inside piston 52. Upper valve 90 has a sealing portion 92 sized for frictional fit inside the lower chamber 66 of the piston 52 and for seating with the inwardly extending flange 68 at the lower end of the lower chamber 66. The sealing portion 92 is sized to provide a clearance between the sealing portion 92 and the upper chamber 64 of the piston. Upper valve 90 is thus movable from the lower chamber 66 to the upper chamber 64 to vent the body 20 during an increase in pressure inside the body 20. Upper valve 90 is further movable from the upper chamber 64 to the lower chamber 66 to close the pump 10 during a decrease in pressure inside the hollow body 20.

Means for biasing the upper valve 90 against upward movement are provided, and preferably comprise a valve spring 94. Valve spring 94 is a coil spring extending between the upper valve sealing portion 92 and a post 105 extending downwardly from the actuator 103. Valve spring 94 has a biasing force selected to operate in conjunction with frictional forces between the tapered and flexible sealing portion 92 and the inner walls of the piston lower chamber 66 to keep the upper valve 90 closed during an increase in pressure inside the pump 10 until a desired pressure is reached. The desired pressure causes the upper valve to push upwardly against the valve spring 94 into the upper chamber 64 of the piston 52 to vent the body 20. After pressure in the body 20 has been vented and decreased, the valve spring 94 causes the upper valve 90 to return from the upper chamber 64 to the lower chamber 66 to close the body 20.

Further structural elements of the upper valve 90 are apparent from the drawings. As can be seen, the sealing portion 92 comprises a flange 96 extending outwardly from and downwardly spaced apart from and along a valve stem 98. Flange 96 comprises a material having a limited resilience whereby an increase in pressure in the body 20 during a downward stroke of the piston 52 causes the flange 96 to flex outwardly to frictionally seal against the lower chamber 66 of the piston 52. However, the amount of flex is engineered to be limited so that the outward flex does not prevent venting of the body 20 when the upper valve 90 is moved into the upper chamber 64 of the piston 52.

Valve stem 98 extends downwardly. Stem 98 has a length selected such that the stem 98 will contact the upper end 48 of the lower valve 40 during the terminal portion of a downward stroke of the piston 52 and an initial portion of an upward stroke of the piston 52. This permits the upper valve 90 to be held open during the terminal portion of the downward stroke of the piston 52 and the initial portion of the upward stroke of the piston 52 to exhaust the piston. This permits priming of the pump 10 with liquid when it is first used.

The lower end 100 of valve stem 98 preferably comprises two opposing tabs 102 extending downwardly. When the pump 10 is first assembled, the piston 52 is depressed with an actuator or an assembly plunger device having a similar structure as the actuator that would be used with the pump 10. This causes the tabs 102 to be forced against the upper end 48 of the lower valve 40 and spread apart as shown in the FIGURES. These spread apart tabs 102 retain the upper valve 90 in the piston 52 as shown in FIG. 6. This retaining of the upper valve 90 in the piston 52 is desirable during shipment prior to assembly of the actuator 103 onto the piston 52.

An actuator 103 is provided for mounting on the upper end 56 of piston 52. Piston upper end 56 is provided with connecting passages such as lateral slots 104 to permit flow of fluid from the pump to further passages in the actuator 103 that connect to a nozzle assembly 106 seated on the upper end 56 of the piston 52. The nozzle assembly 106 is thus operably connected with the pump 10. An actuator cap such as a brass shell 108 may be fitted over the actuator 103 for decorative enhancement.

A mounting cup 110 is fitted onto the collar 76. Both the collar 76 and mounting cup 110 have central apertures 112 and 114 respectively therein through which extends the piston 52. Mounting cup 110 is preferably made of the same material as the actuator cap to provide a uniform decorative appearance, although other materials may be used for a different decorative effect.

In the preferred embodiment of the invention, the operating components of the pump 10 are preferably formed of a plastic material such as polypropylene, and the decorative shells and cap elements may be either of a plastic or metal depending on the desired appearance of the pump.

Figure 2:
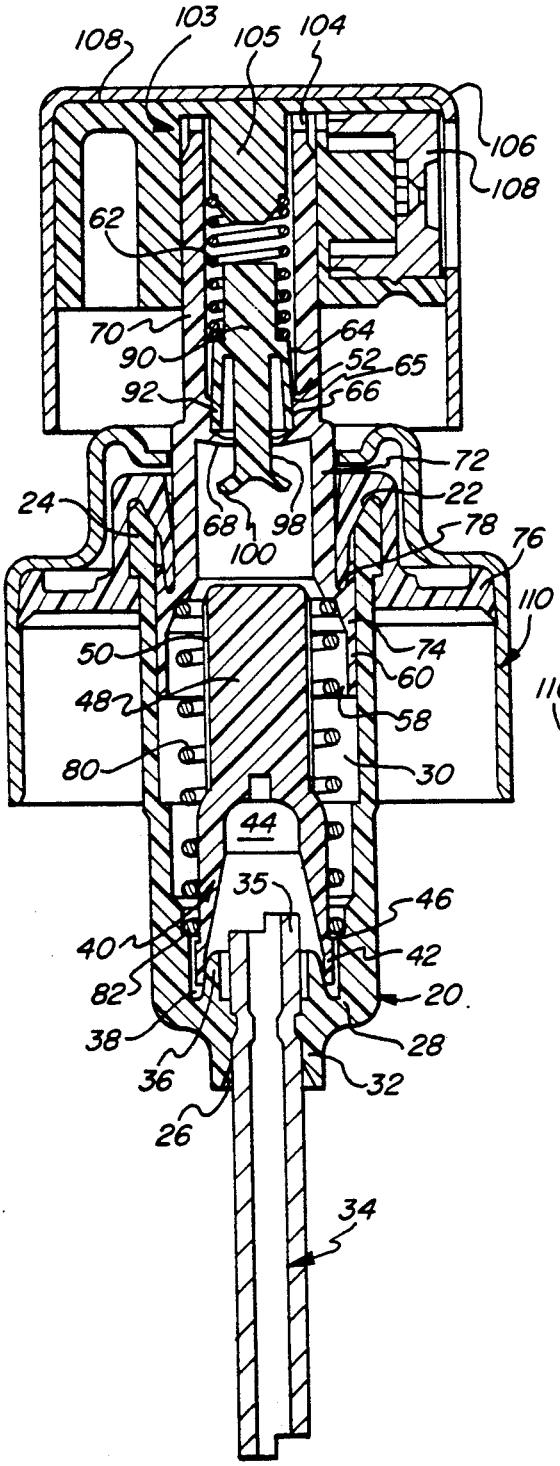
FIG. 2 is a cross-sectional view of an embodiment of a pump of the present invention with its piston in a neutral up or "rest" position.

The operation of pump 10 is shown in FIGS. 2–6. In FIG. 2, the pump is at a neutral rest position, in which the upper valve 90 is closed and the lower valve 40 is seated loosely in the channel 38. In FIG. 3, force applied to actuator 103 by the user causes the piston 52 to move downwardly, and the lower valve 40 to seat in channel 38 because of the frictional engagement of the piston 52 on the ribs 50 of upper end 48 of lower valve 40. In FIG. 4 the upper valve 90 of piston 52 is opened as the piston has moved downwardly in body 20 a sufficient distance to cause a pressure increase in chamber 73 in the middle zone 72 of piston 52. The pressure in chamber 73 opens the upper valve 90 when it is sufficient to overcome the resistance of valve spring 94 and the frictional resistance between sealing portion 92 of valve 90 and the walls of the lower chamber 66 of piston 52. FIG. 5 shows the terminal portion of a downward stroke and the initial portion of an upward stroke of the piston 52. As can be seen, the upper valve 90 is held open at the very end of the stroke by virtue of the stem 98 abutting the upper end 48 of lower valve 40. This vents the chamber 73, and is particularly useful to prime pump 10 with liquid, as the force of air pressure alone may be insufficient to displace the upper valve to vent chamber 73. FIG. 6 shows the upward stroke of piston 52 where the upper valve 90 has now been closed by the operation of valve spring 94 which seats upper valve 90 back into the lower chamber 66 against flange 68. The upward stroke is driven by the piston spring 80. FIG. 6 also shows the opening of lower valve 40 by the lifting up of the valve 40 by the piston 52. This is again caused by the frictional interengagement of the piston 52 with the lower valve upper end 48.

By comparing FIGS. 3 and 4, the operation of upper valve 90 will now be described. In order for the upper valve 90 to open, the pressure in chamber 73 must increase sufficiently to overcome the force of spring 94 and the friction between the valve 90 and the cylindrical wall of the lower chamber 66. More specifically, the tapered and flexible sealing portion 92 frictionally engages the cylindrical wall of the lower chamber 66 as it moves upwardly against the bias of valve spring 94. As the pressure builds up in the body 20, valve 90 moves upwardly against the bias of valve spring 94. Once the sealing portion 92 reaches the transition 65, the frictional engagement between the valve 90 and valve chamber 62 is suddenly released, and liquid is dispensed as shown by the arrows shown in FIG. 4. The tapered transition 65 permits the tapered sealing portion 92 of valve 90 to slide smoothly back into engagement with the inner cylindrical wall of lower chamber 66 when the pressure is released and the piston 52 is in an upward stroke.

The operation of the pump 10 also permits it to have a low profile. The pump 10 is operable with a very short piston travel. The pump 10 can thus be mounted on a container without having the piston extend upwardly for a long distance, and the body of the pump can have a relatively short length. This permits the pump to be used in a clear glass bottle, for example in a fragrance dispensing package, while still providing an aesthetically pleasing appearance.

The chamber 73 of pump 10 also contributes to the low profile of the pump. Chamber 73 is sized to contain the desired shot size. In comparison to the pump chambers of many prior art pumps, chamber 73 is a free space because of the lack of a lower valve therein. The distance between the elements of the upper valve and the lower valve provides a significant volume to accommodate a desired shot size while still maintaining a pump package that does not extend deeply into a container.

Figure 7:
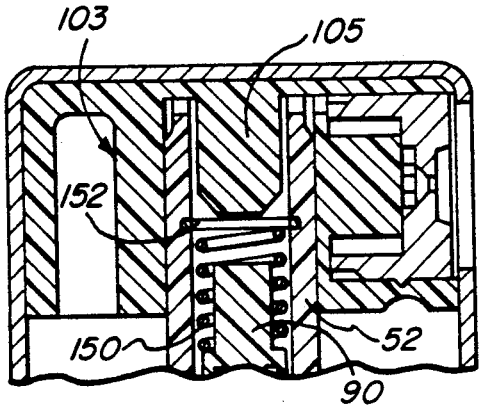
FIG. 7 shows another embodiment of the invention and is a cross-sectional view of the upper portion of a pump similar to that shown in FIG. 6.

Referring to FIG. 7, an alternative embodiment is shown wherein the spring 150 has an end that is formed with a larger diameter that fits into an annular groove 152. This groove holds the end of the spring in a fixed position relative to piston 52 and maintains the spring 150 in compression when the actuator is not present during shipping. The compression maintains the valve 90 in a closed position during shipment to prevent leakage.

It is to be appreciated that the foregoing is illustrative and not limiting of the invention, and that the practitioner may also develop other embodiments all within the scope of the invention.

We claim:

1. A pump for dispensing liquids from a container, comprising:

a hollow body having upper and lower ends having openings therein;

a lower valve located in and adapted to close said opening in said lower end of said body during an increase in pressure inside said hollow body and to open said opening in said lower end during a decrease in pressure inside said hollow body, said lower valve having an upper end extending upwardly inside said body;

a hollow piston fitted into said upper end of said body and retained in and slidable reciprocally with sealing fit in said body against a spring bias, said piston having upper and lower ends having openings therein, said piston having an upper chamber and a lower chamber connected together, said lower chamber having a diameter which is less than the diameter of said upper chamber;

an upper valve fitted into and slidable reciprocally inside said piston and having a sealing portion sized for frictional fit inside said lower chamber of said piston, said sealing portion being sized to provide a clearance between said sealing portion and said upper chamber of said piston, said upper valve being movable from said lower chamber to said upper chamber to vent said body during an increase in pressure inside said hollow body and being movable from said upper chamber to said lower chamber to close said body during a decrease in pressure inside said hollow body, said upper valve further comprising a central stem extending downwardly, said stem having a length selected such that said stem will contact said upper end of said lower valve during the terminal portion of a downward stroke of said piston and an initial portion of an upward stroke of said piston whereby said upper valve is held open during said terminal portion of said downward stroke of said piston and said initial portion of said upward stroke of said piston; and means for biasing said upper valve against upward movement, said biasing means having biasing force selected to operate in conjunction with frictional forces between said sealing portion of said upper valve and said lower chamber to keep said upper valve closed during an increase in pressure inside said body until said frictional force is released when said upper valve is caused to slide upwardly against said biasing means into said upper chamber of said piston to thereby vent said body, and thereafter when pressure in said body has decreased to return said upper valve from said upper chamber to said lower chamber to close said body.

2. A pump in accordance with claim 1, wherein said lower end of said piston receives said lower valve upper end with frictional fit, whereby said lower valve is frictionally engaged with said piston to seat said lower valve against and to close said opening in said lower end of said body during a downward stroke of said piston and to unseat said lower valve from and to open said opening in said lower end of said body during an upward stroke of said piston.

3. A pump in accordance with claim 2 wherein said upper end of said lower valve is provided with a plurality of ribs for enhancing said frictional fit between said lower valve and said piston.

4. A pump in accordance with claim 2 wherein said lower end of said body has an annular ring extending upwardly whereby a channel ha an annular ring extending upwardly whereby a channel is located inside said lower end of said body between said ring and an inner wall of said body and sad lower valve has a lower end for fitting into said channel in said lower end of said body and for sealing fit against said ring.

5. A pump in accordance with claim 2 wherein said lower valve lower end is provided with a cavity therein for fitting over said opening in said lower end of said body.

6. A pump in accordance with claim 4 wherein said channel and lower end of said lower valve are annular.

7. A pump in accordance with claim 2 further comprising a spring for biasing said piston against a downward stroke and for biasing said piston with an upward stroke, a lower end of said spring acting on a lower end of said lower valve to retain said lower valve in a predetermined zone of movement.

8. A pump in accordance with claim 1 wherein said central stem of said upper valve has a lower end comprising two opposing tabs extending downwardly, said tabs being deformable to spread apart and retain said upper valve in said piston.

9. A pump in accordance with claim 1 wherein said piston has an inner cross-section which tapers from a cross-section of said upper chamber to a cross-section of said lower chamber.

10. A pump in accordance with claim 1 wherein said upper valve sealing portion comprises a tapered flange extending outwardly from and downwardly along a valve stem.

11. A pump in accordance with claim 10 wherein said upper valve flange comprises a material having a limited resilience whereby an increase in pressure in said body during a downward stroke of said piston causes said flange to flex outwardly to frictionally seal against said lower chamber of said piston but whereby said outward flex does not prevent venting of said body when said upper valve is moved into said upper chamber of said piston.

12. A pump in accordance with claim 1 further comprising an actuator and nozzle assembly seated on the upper end of said piston and operably connected with said piston chambers.

13. A pump in accordance with claim 12 further comprising a collar for mounting on said body and for retaining said piston in said body, and a mounting cup fitted onto said collar, said collar and mounting cup having central apertures therein through which extends said piston.

14. A pump in accordance with claim 12 wherein said biasing means comprises a coil spring extending between said upper valve sealing portion and a post extending downwardly from said actuator.

15. A pump in accordance with claim 1 wherein said biasing means comprises a coil spring in compression between said upper valve and means for holding the spring in a fixed position with respect to the piston.

16. A pump in accordance with claim 15 wherein said holding means comprises an annular groove in said piston and wherein said spring has an end portion, said end portion having an enlarged diameter fitting within said annular groove.

17. A pump for dispensing liquids from a container, comprising:

a hollow body having upper and lower ends having openings therein;

a hollow piston fitted into said upper end of said body and retained in and slidable reciprocally with sealing fit in said body, said piston having upper and lower ends having openings therein, said piston having a cylindrical upper chamber and a cylindrical lower chamber connected by a tapered transition, said lower chamber having a diameter smaller than the diameter of the upper chamber;

a lower valve located in and adapted to close said opening in said lower end of said body during an increase in pressure inside said hollow body and to open said opening in said lower end during a decrease in pressure inside said hollow body, said lower valve having an upper end extending upwardly inside said body, said lower end of said piston receives said lower valve upper end with frictional fit, whereby said lower valve is frictionally engaged with said piston to seat said lower valve against and to close said opening in said lower end of said body during a downward stroke of said piston and to unseat said lower valve from and to open said opening in said lower end of said body during an upward stroke of said piston;

a piston spring for biasing said piston against a downward stroke and for biasing said piston with an upward stroke, a lower end of said spring acting on a lower end of said lower valve to retain said lower valve in a predetermined zone of movement;

an upper valve having a valve flange and a valve stem, said upper valve fitted into and slidable reciprocally inside said piston, said valve flange extending outwardly from and downwardly along said valve stem, said valve flange sized for frictional fit inside said lower chamber, said valve flange being sized to provide a clearance between said valve flange and said upper chamber of said piston, said upper valve being movable from said lower chamber to said upper chamber to vent said body during an increase in pressure inside said hollow body during a downward stroke of said piston and being movable from said upper chamber to said lower chamber to close said body during a decrease in pressure inside said hollow body during an upward stroke of said piston, said valve flange comprising a material having a limited resilience whereby an increase in pressure in said body causes said flange to flex outwardly to frictionally seal against said lower chamber of said piston but whereby said outward flex does not prevent venting of said body when said upper valve is moved into said upper chamber of said piston, said stem of said upper valve extending downwardly to a length selected such that said stem will contact said upper end of said lower valve during the terminal portion of a downward stroke of said piston and an initial portion of an upward stroke of said piston whereby said upper valve is held open during said terminal portion of said downward stroke of said piston and said initial portion of said upward stroke of said piston; and an upper valve spring for biasing said upper valve against upward movement, said biasing means having a biasing force selected to operate in conjunction with frictional forces between said valve flange and said lower chamber to keep said upper valve closed during an increase in pressure inside said body until a predetermined pressure is reached whereby said upper valve is caused to slide upwardly against a bias of said upper valve spring into said upper chamber of said piston to vent said body, and thereafter when pressure in said body has decreased to return said upper valve from said upper chamber to said lower chamber to close said body.

18. A pump in accordance with claim 17 wherein said central stem of said upper valve has a lower end comprising two opposing tabs extending downwardly, said tabs being deformable to spread apart and retain said upper valve in said piston.

19. A pump in accordance with claim 17 wherein said upper end of said lower valve is provided with a plurality of ribs for enhancing said frictional fit between said lower valve and said piston.

20. A pump in accordance with claim 17 wherein said lower end of said body has an annular ring extending upwardly whereby a channel is located inside said lower end of said body between said ring and an inner wall of said body and said lower valve has a lower end for fitting into said channel in said lower end of said body and for sealing fit against said ring.

21. A pump in accordance with claim 20 wherein said lower valve lower end is provided with a cavity therein for fitting over said opening in said lower end of said body.

22. A pump in accordance with claim 20 wherein said channel and lower end of said lower valve are annular.

23. A pump in accordance with claim 17 further comprising an actuator and nozzle assembly seated on the upper end of said piston and operably connected with said piston chambers.

24. A pump in accordance with claim 17, wherein said body has a length selected such that said pump has a relatively short length in the container.

25. A pump for dispensing liquids from a container, comprising:

a hollow body having upper and lower ends having openings therein;

a lower valve located in and adapted to close said opening in said lower end of said body during an increase in pressure inside said hollow body and to open said opening in said lower end during a decrease in pressure inside said hollow body;

a hollow piston fitted into said upper end of said body and retained in and slidable reciprocally with sealing fit in said body against a spring bias, said piston having upper and lower ends having openings therein, said piston having an upper chamber and a lower chamber connected together, said lower chamber having a diameter which is less than the diameter of said upper chamber;

an upper valve fitted into and slidable reciprocally inside said piston and having a sealing portion sized for frictional fit inside said lower chamber of said piston, said sealing portion being sized to provide a clearance between said sealing portion and said upper chamber of said piston, said upper valve being movable from said lower chamber to said upper chamber to vent said body during an increase in pressure inside said hollow body and being movable from said upper camber to said lower chamber to close said body during a decrease in pressure inside said hollow body;

means for biasing said upper valve against upward movement, said biasing means having a biasing force selected to operate in conjunction with frictional forces between said sealing portion of said upper valve and said lower chamber to keep sad upper valve closed during an increase in pressure inside said body until said frictional force is released when said upper valve is caused to slide upwardly against said biasing means into said upper chamber of said piston to thereby vent said body, and thereafter when pressure in said body has decreased to return said upper vale from said upper chamber to said lower chamber to close said body;

said lower valve having an upper end extending upwardly inside said body and said piston having a lower end for receiving said lower valve upper end with frictional fit, whereby said lower valve is frictionally engaged with said piston to seat said lower valve against and to close said opening in said lower end of said body during a downward stroke of said piston and to unseat said lower valve from and to open said opening in said lower end of said body during an upward stroke of said piston; and a spring for biasing said piston against a downward stroke and for biasing said piston against a downward stroke and for biasing said piston with an upward stroke, a lower end of said spring acting on a lower end of said lower valve to retain said lower valve in a predetermined zone of movement.

* * * * *